US012649089B2

(12) United States Patent
Nakano

(10) Patent No.: US 12,649,089 B2
(45) Date of Patent: Jun. 9, 2026

(54) COLLECTOR

(71) Applicant: YAMABIKO CORPORATION, Tokyo (JP)

(72) Inventor: Kenji Nakano, Tokyo (JP)

(73) Assignee: YAMABIKO CORPORATION, Tokyo (JP)

( * ) Notice: Subject to any disclaimer, the term of this patent is extended or adjusted under 35 U.S.C. 154(b) by 365 days.

(21) Appl. No.: 18/564,829

(22) PCT Filed: May 31, 2021

(86) PCT No.: PCT/JP2021/020759
§ 371 (c)(1),
(2) Date: Nov. 28, 2023

(87) PCT Pub. No.: WO2022/254558
PCT Pub. Date: Dec. 8, 2022

(65) Prior Publication Data

US 2024/0286007 A1 Aug. 29, 2024

(51) Int. Cl.
*A63B 47/02* (2006.01)
*A63B 102/32* (2015.01)

(52) U.S. Cl.
CPC ..... *A63B 47/021* (2013.01); *A63B 2047/022* (2013.01); *A63B 2102/32* (2015.10)

(58) Field of Classification Search
CPC ..... A63B 47/021; A63B 2047/022
See application file for complete search history.

(56) References Cited

U.S. PATENT DOCUMENTS 9,114,285 B2 * 8/2015 Guo ..... A63B 47/021
11,439,874 B2 * 9/2022 Nakano ..... A63B 47/021
2009/0137348 A1 5/2009 Tsai
(Continued)

FOREIGN PATENT DOCUMENTS

CN 201823250 U 5/2011
CN 103830890 B 2/2016
CN 206167802 5/2017
(Continued)

OTHER PUBLICATIONS

International Search Report pertaining to PCT/JP2021/020759, mailed Jul. 13, 2021.
(Continued)

*Primary Examiner* — Mark C Hageman
(74) *Attorney, Agent, or Firm* — GRUMBLES LAW PLLC; Brittany Haanan

(57) ABSTRACT

A collector comprises a main body comprising: front wheels; rear wheels; a driving device; a battery; a collection device to pick up a ball; and a collection container to accommodate the ball. The battery and the collection container are disposed between respective axles for the front and rear wheels, and respective positions of centers of gravity of the battery and the collection container are situated in an area defined between a first tangential line tangent to an upper portion of the front wheel and an upper portion of the rear wheel and a second tangential line tangent to a lower portion of the front wheel and a lower portion of the rear wheel. This structure improves weight balance of the collector and enhances stability during travel.

12 Claims, 4 Drawing Sheets

(56) References Cited

U.S. PATENT DOCUMENTS

2020/0086182 A1* 3/2020 New ..... A63B 47/02

FOREIGN PATENT DOCUMENTS

| | | | |
|---|---|---|---|
| CN | 206934647 | U | 1/2018 |
| CN | 207000216 | U | 2/2018 |
| CN | 208877850 | | 5/2019 |
| CN | 210186376 | U | 3/2020 |
| JP | H0480565 | A | 3/1992 |
| JP | 3014060 | | 8/1995 |
| JP | H08276037 | A | 10/1996 |
| JP | 2020174955 | A | 10/2020 |

OTHER PUBLICATIONS

Japanese Office Action pertaining to corresponding Japanese Patent Application No. 2023-525199.
Extended European Search Report pertaining to European Patent Application No. 21944066.6, mailed Feb. 26, 2025.

* cited by examiner

COLLECTOR

TECHNICAL FIELD

The present invention relates to a collector.

BACKGROUND ART

Some collectors for collecting balls (collection targets) scattered on a ground of a golf practice range have a main body in which a battery to supply electric power to a motor for driving wheels, a collection device to pick up balls off the ground, and a collection container to accommodate and carry the collected balls are disposed in a distributed manner (see Patent Literature 1, for example).

CITATION LIST

Patent Literature

Patent Literature 1: Japanese Unexamined Utility Model Application Publication No. Hei 4-80565

SUMMARY OF INVENTION

Technical Problems

In the conventional collector described above, the battery, the collection device, and the collection container included in the collector are all heavy. This leads to such a problem that a position of a center of gravity of the whole collector varies easily due to a slope of a ground or the number of balls collected. This makes the collector unstable during travel.

Also, in the conventional collector described above, since the battery, which is one of heavy components, is disposed at a high position on the rear side in a traveling direction, there is a problem that the collector has low stability in the vertical direction. In particular, when the collector travels on a surface of the ground sloped with respect to a horizontal plane and a front side of the collector is positioned higher than a rear side of the collector, the front side of the collector may lift off the surface of the ground.

The present invention solves the problems described above and is directed to a collector having an excellent weight balance. This results in enhancing stability during travel irrespective of ground conditions and the number of collection targets collected.

Solution to Problems

To achieve the above-described object, the present invention provides a collector including a main body including: a travel device having front and rear wheels; an electric driving device to drive the travel device; a battery to supply electric power to the driving device; a collection device to pick up a collection target on a surface of ground; and a collection container to accommodate the collection target. At least part of the battery and at least part of the collection container are disposed between respective axles for the front and rear wheels. Respective positions of centers of gravity of the battery and the collection container are situated in an area defined between a first tangential line tangent to an upper portion of the front wheel and an upper portion of the rear wheel and a second tangential line tangent to a lower portion of the front wheel and a lower portion of the rear wheel.

Advantageous Effects of Invention

In the collector of the present invention, the battery and the collection container are disposed between the axles for the front and rear wheels. This improves the weight balance in a longitudinal (or front-rear) direction. Also, in the collector of the present invention, the positions of the centers of gravity of the battery and the collection container having heavy weights are set near the center of the main body. This reduces variation in the position of the center of gravity due to an increase or decrease in the number of collection targets collected and makes the main body compact in the longitudinal direction. As described above, the collector of the present invention has an excellent weight balance and stability during travel irrespective of ground conditions and the increase or decrease in the number of collection targets collected.

DESCRIPTION OF EMBODIMENTS

Embodiments as examples of the present invention will be described in detail with reference to the drawings as appropriate.

Note that, in the description of each embodiment, identical constituent components are denoted by the same reference sign and overlapping description is omitted.

In each of the following embodiments, a configuration of a collector of the present invention used in a golf practice range (ball game field) will be described as an example.

First Embodiment

Figure 1:
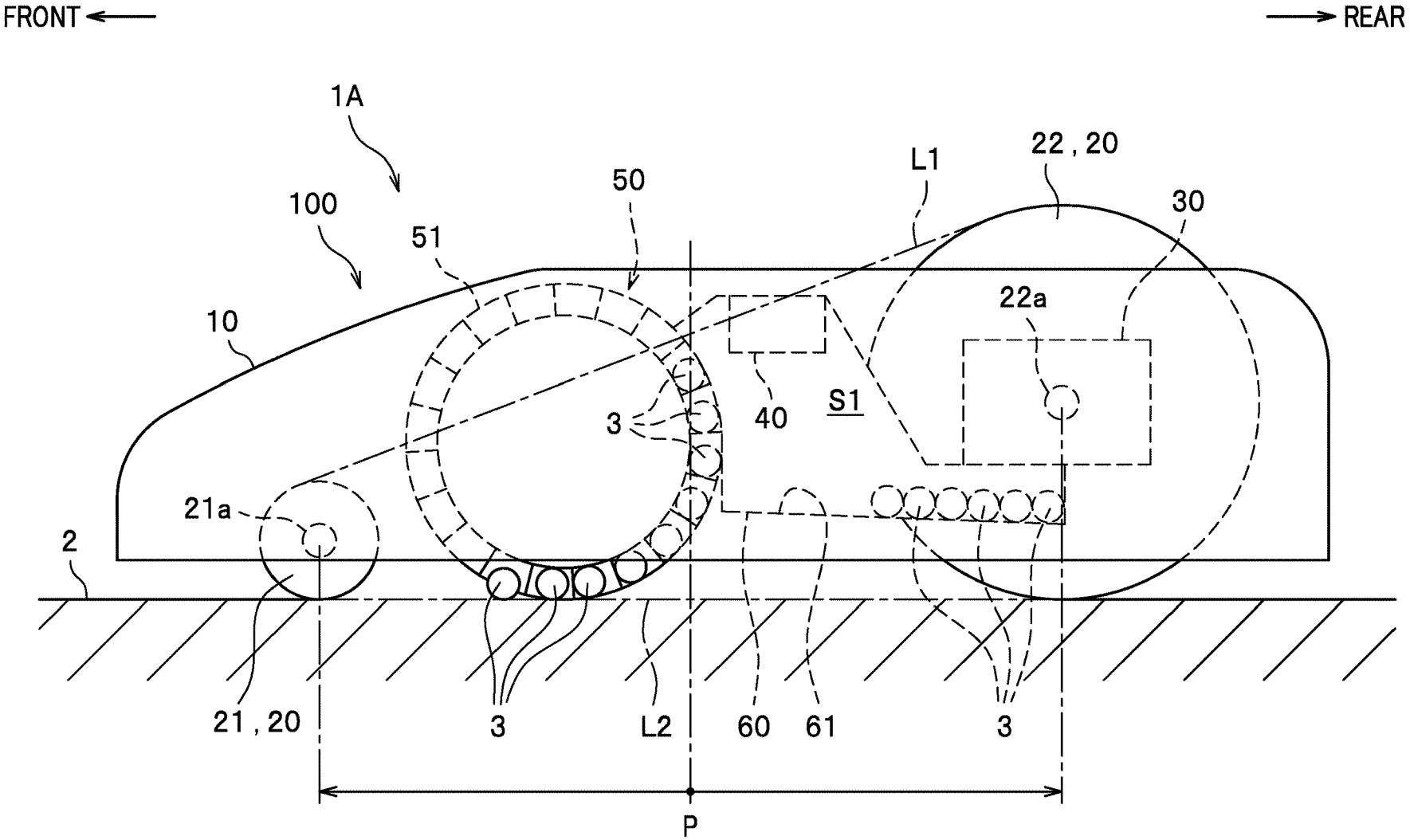
FIG. 1 is a side view showing a collector according to a first embodiment of the present invention.

As shown in FIG. 1, a collector 1A of a first embodiment is a vehicle capable of picking up and collecting a plurality of balls 3 as collection targets scattered on a ground 2 while moving on a surface of the ground 2.

The collector 1A includes a main body 100 including a vehicle body 10, a travel device 20, a driving device 30, a battery 40, a collection device 50, and a collection container 60.

The travel device 20 includes front wheels 21 provided at a front side of the vehicle body 10 (front wheel) and rear wheels 22 provided at a rear side of the vehicle body 10 (rear wheel). In the collector 1A of the first embodiment, an outer diameter of the rear wheels 22 is larger than an outer diameter of the front wheels 21.

Figure 2:
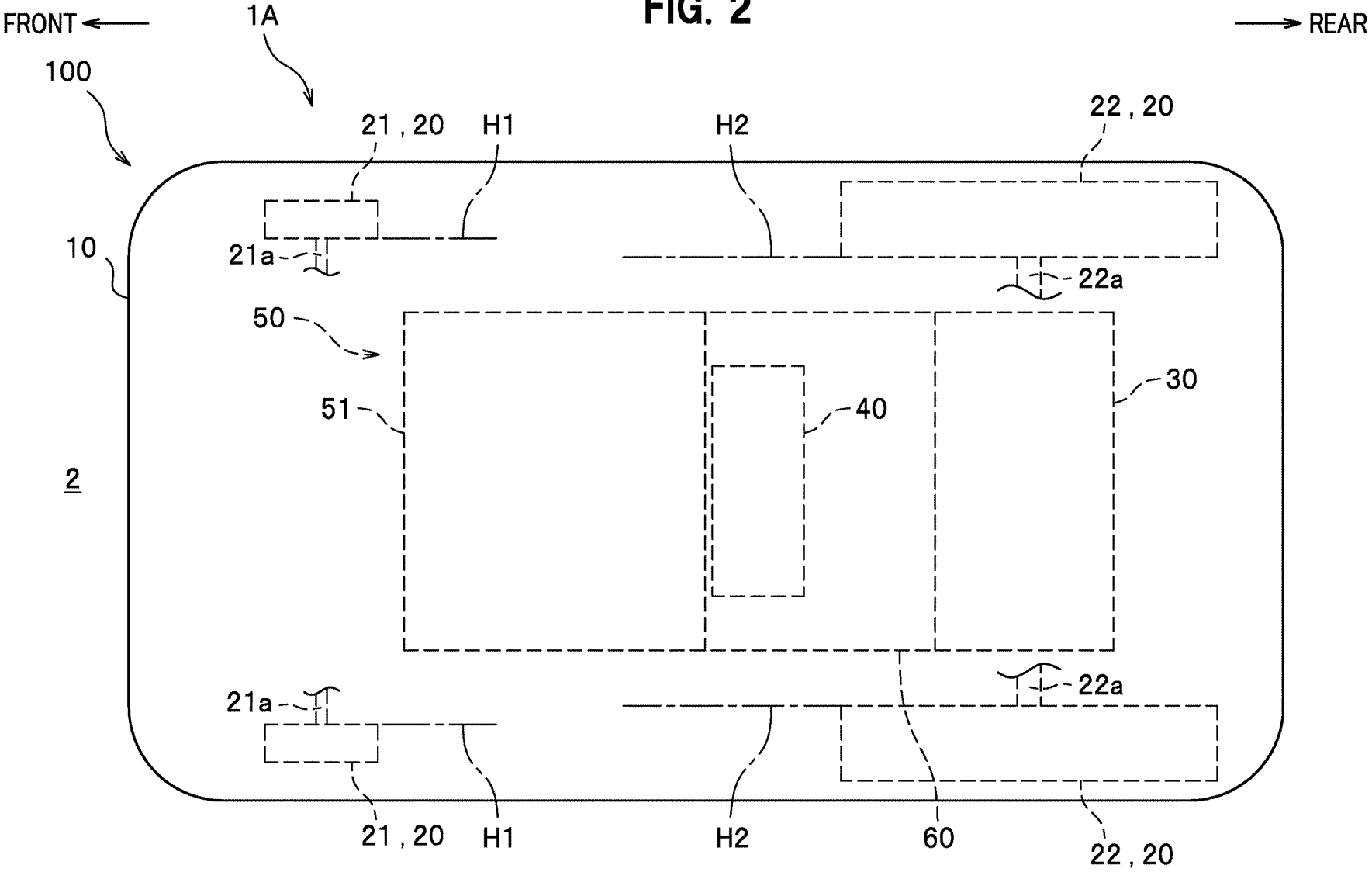
FIG. 2 is a plan view showing the collector according to the first embodiment of the present invention.

In the first embodiment, as shown in FIG. 2, the two front wheels 21 and 21 are disposed with a distance therebetween in a lateral direction (vehicle width direction). Also, the two rear wheels 22 and 22 are disposed with a distance therebetween in the lateral direction (vehicle width direction).

In the first embodiment, inner ends H2 of the rear wheels 22 are disposed inside of inner ends H1 of the corresponding front wheels 21 in a plan view of the main body 100.

Meanwhile, the inner ends H1 of the front wheels 21 and the inner ends H2 of the corresponding rear wheels 22 may be disposed on the same lines, or the inner ends H2 of the rear wheels 22 may be disposed outside of the inner ends H1 of the corresponding front wheels 21.

The driving device 30 is an electrical driving source to operate mechanisms of the collector 1A. The driving device 30 of the first embodiment includes an electric motor. The driving device 30 is driven by electric power supplied from the battery 40.

The driving device 30 of the first embodiment is disposed between the left and right rear wheels 22 and 22 at the rear side of the vehicle body 10.

The driving device 30 of the first embodiment drives the rear wheels 22 and 22. An axle 22*a* for the rear wheels 22 and 22 is attached to an output part of the driving device 30.

The collector 1A is capable of traveling on the surface of the ground 2 by driving the rear wheels 22 and 22 with the driving device 30.

The collector 1A of the first embodiment is configured to move on the surface of the ground 2 by driving the travel device 20 and the driving device 30 with a controller mounted in the main body 100 or by a remote operation with a transmitter based on positional information from a GNSS (Global Navigation Satellite System), such as GPS or a millimeter-wave radar.

As shown in FIG. 1, in a side view of the main body 100, the collection device 50 is disposed between an axle 21*a* for the front wheels 21 and the axle 22*a* for the rear wheels 22.

In the first embodiment, the whole collection device 50 is disposed between the front and rear axles 21*a* and 22*a* in the side view of the main body 100. Meanwhile, part of the collection device 50 may be disposed between the front and rear axles 21*a* and 22*a*.

The collection device 50 includes a drum 51 that rotates about a shaft extending along the lateral direction (vehicle width direction) and is configured to scoop up the balls 3 on the ground 2 with grooves formed in an outer periphery of the drum 51.

Thus, the collection device 50 is capable of picking up the balls 3 which roll on the surface of the ground 2. The collection device 50 is also capable of picking up the balls 3 even from the surface of the ground 2 that is sloped with respect to a horizontal plane.

In order to increase efficiency of collection of the balls 3, the drum 51 of the collection device 50 is usually made large in diameter and is one of the parts occupying a large volume among the constituent parts of the main body 100. Further, the collection device 50 can be in a state of holding the balls 3 in all of a plurality of collection portions of the drum 51 or in a state of not holding the balls 3 in all of the collection portions. Accordingly, a weight of the collection device 50 varies between a maximum weight at which the collection device 50 holds a maximum number of the balls 3 and a minimum weight at which the collection device 50 holds no ball 3. In other words, the amount of variation in the weight of the collection device 50 alone corresponds to the total weight of the balls 3 that is to be collected in the collection device 50.

Also, the collector 1A is configured such that the collection device 50 stops collecting the balls 3 when the number of the collected balls 3 reaches a maximum amount in the collection container 60 to be described later. Specifically, the collector 1A is configured to raise the drum 51 of the collection device 50 off the surface of the ground 2 and travel without letting the drum 51 touch the balls 3 so that the collection device 50 does not collect the balls 3. Here, the movement of the collection device 50 in a vertical direction may vary a weight balance of the main body 100.

As mentioned above, the weight of the collection device 50 varies according to the number of the balls 3 collected, and the center of gravity of the collection device 50 varies due to its movement in the vertical direction. To reduce such a variation in the weight balance of the main body 100 originating in the collection device 50, at least part of the collection device 50 is desirably disposed between the front and rear axles 21*a* and 22*a*. This configuration stabilizes the collector 1A during travel even when the ground 2 is sloped, the number of the balls 3 collected increases or decreases, or the collection device 50 is moved.

The collection container 60 is disposed between the axle 21*a* for the front wheels 21 and the axle 22*a* for the rear wheels 22 in the side view of the main body 100.

Moreover, the collection container 60 is disposed between the collection device 50 and the rear wheels 22 in the side view of the main body 100.

In the first embodiment, the whole collection container 60 is disposed between the front and rear axles 21*a* and 22*a* in the side view of the main body 100. Meanwhile, part of the collection container 60 may be disposed between the front and rear axles 21*a* and 22*a*.

The collection container 60 is a tank capable of accommodating a plurality of the balls 3. The balls 3 taken into the collection device 50 are sent into the collection container 60 from the collection device 50. The collection container 60 is provided with a discharge mechanism to discharge the balls 3 to the outside of the main body 100.

A weight of the collection container 60 varies according to the number of the balls 3 accommodated therein. General self-propelled collection devices are desired to collect as many balls 3 as possible. The weight of the collection container 60 varies greatly within a range from a state of accommodating no ball 3 to a state of accommodating the maximum number of the balls 3. Such a variation in the weight of the collection container 60 may lower the stability of the collector 1A during travel.

To address this, in the collector 1A of the first embodiment, at least part of the collection container 60 is disposed between the front and rear axles 21*a* and 22*a*. With this configuration, even when the weight of the collection container 60 varies, the center of gravity of the whole main body 100 is situated between the front and rear axles 21*a* and 22*a*. This enhances the stability of the collector 1A during travel.

Further, during travel of the collector 1A, the collection container 60 undergoes a variation in the center of gravity due to the balls 3 rolling inside the collection container 60, in addition to the weight variation in the collection container 60 described above. In particular, when the ground 2 is sloped, the balls 3 moves inside the collection container 60 or some balls 3 unevenly stay at one area of the collection container 60 as the main body 100 is tilted. This may affect the stability of the main body 100.

To address this, the collector 1A of the first embodiment has a bottom surface 61 of the collection container 60 that is inclined such that a rear side of the bottom surface 61 is lower than a front side of the bottom surface 61. Owing to such inclination of the bottom surface 61 of the collection container 60, the balls 3 gather at an area of the bottom surface 61 closer to the ground surface (low area). This inclination prevents the balls 3 stored in the collection container 60 from moving during travel of the collector 1A and makes the center of gravity of the collection container 60 unlikely to vary. An inclination angle of the bottom surface 61 of the collection container 60 is set as appropriate based on a maximum slope angle at which the collector 1A is allowed to travel and use conditions of the collector 1A, so that the balls 3 inside the collection container 60 do not move during travel of the collector 1A.

The battery 40 is disposed between the axle 21*a* for the front wheels 21 and the axle 22*a* for the rear wheels 22 in the side view of the main body 100. Moreover, the battery 40 is disposed behind an intermediate position P between the front and rear axles 21*a* and 22*a* in the side view of the main body 100.

Furthermore, the battery 40 is disposed between the collection device 50 and the axle 22*a* for the rear wheels 22 in the side view of the main body 100.

The weight of the battery 40 does not vary between before and after the collector 1A works. In the collector 1A of the first embodiment, the battery 40 having a heavy weight is disposed between the front and rear axles 21*a* and 22*a* and is positioned near heavy parts such as the collection container 60. Hence, the position of the center of gravity of the battery 40 is situated between the front and rear axles 21*a* and 22*a*, thereby stabilizing the main body 100. In this way, the stability of the collector 1A during travel enhances even when the ground 2 is sloped, the number of the balls 3 collected with the collection device 50 varies, or the number of the balls 3 accommodated in the collection container 60 varies.

In the first embodiment, the whole battery 40 is disposed between the front and rear axles 21*a* and 22*a* in the side view of the main body 100. Meanwhile, part of the battery 40 may be disposed between the front and rear axles 21*a* and 22*a*.

Also, in the first embodiment, the whole battery 40 is disposed behind the intermediate position P between the front and rear axles 21*a* and 22*a* in the side view of the main body 100. Meanwhile, part of the battery 40 may be disposed behind the intermediate position P between the front and rear axles 21*a* and 22*a*.

Alternatively, at least part of the battery 40 may be disposed in front of the intermediate position P between the axles 21*a* and 22*a* in the side view of the main body 100.

Further, in the first embodiment, the whole battery 40 is disposed between the collection device 50 and the axle 22*a* in the side view of the main body 100. Meanwhile, part of the battery 40 may be disposed between the collection device 50 and the axle 22*a*.

The battery 40 is accommodated in an upper portion of the inside of the collection container 60, and the battery 40 and the collection container 60 overlap with each other in the vertical direction. Disposing the battery 40 in this manner makes a vehicle height of the collector 1A low and keeps a posture of the collector 1A from being unstable due to the vehicle height.

The battery 40 is disposed above the front side of the bottom surface 61 of the collection container 60. Specifically, the battery 40 is disposed above the front side of the bottom surface 61 inclined such that the rear side of the bottom surface 61 is lower than the front side of the bottom surface 61. By disposing the battery 40 in this manner, the battery 40, of which the weight and the position of the center of gravity do not vary, serve as a balancer for the collection container 60, of which the weight tends to vary. This reduces variation in the position of the center of gravity of the whole collector 1A.

In the first embodiment, the battery 40 is accommodated in the upper portion of the inside of the collection container 60. Meanwhile, the battery 40 may be disposed outside of the collection container 60.

Also, in the first embodiment, the whole battery 40 overlaps the collection container 60 in the vertical direction. Meanwhile, part of the battery 40 may overlap the collection container 60 in the vertical direction. In this manner, the collection container 60 having large weight variations overlaps at least part of the battery 40 having no weight variation and a stable position of the center of gravity. This overlap disposition reduces variation of the center of gravity of the whole collector 1A, thereby enhancing the stability of the orientation of the collector 1A.

In the collector 1A of the first embodiment, the positions of the centers of gravity of the battery 40 and the collection container 60 are situated in an area S1 defined between a first tangential line L1 tangent to upper portions of the front wheels 21 and upper portions of the rear wheels 22 and a second tangential line L2 tangent to lower portions of the front wheels 21 and lower portions of the rear wheels 22 in the side view of the main body 100. This enhances stability of the collector 1A during travel even when the ground 2 is sloped and makes the main body 100 compact.

In the first embodiment, part of the battery 40 and part of the collection container 60 are disposed in the area S1 in the side view of the main body 100. Meanwhile, the whole battery 40 and the whole collection container 60 may be disposed in the area S1. This makes the collection container 60 not come into contact with the surface of the ground 2 even when the collector 1A overturns due to the slope of the ground 2 being steeper than expected or presence of dents. This dampens the impact on the battery 40 and the collection container 60 and prevents the battery 40 and the collection container 60 from being damaged.

In the collector 1A of the first embodiment, as shown in FIG. 2, at least part of the battery 40 and at least part of the collection container 60 are disposed inside of the inner ends H1 and H1 of the front wheels 21 and 21 and inside of the inner ends H2 and H2 of the rear wheels 22 and 22 in a plan view of the main body 100. With this configuration, the battery 40 and the collection container 60 having heavy weights disposed close to the center of the collector 1A in the lateral direction which is perpendicular to a travel direction. This enhances the stability of the collector 1A during travel.

In the first embodiment, the whole battery 40 and the whole collection container 60 are disposed inside of the inner ends H1 and H1 of the front wheels 21 and 21 and inside of the inner ends H2 and H2 of the rear wheels 22 and 22 in the plan view of the main body 100. Meanwhile, part of the battery 40 and part of the collection container 60 may be disposed inside of the inner ends H1 and H1 of the front wheels 21 and 21 and inside of the inner ends H2 and H2 of the rear wheels 22 and 22.

In the collector 1A as described above, as shown in FIG. 1, the battery 40, the collection container 60, and the collection device 50 are disposed between the front and rear axles 21*a* and 22*a*, and the battery 40 is disposed between the collection device 50 and the rear axle 22*a*.

Also, in the collector 1A of the first embodiment, the positions of the centers of gravity of the battery 40 and the collection container 60 are situated in the area S1 defined between the first tangential line L1 tangent to the upper portions of the front wheels 21 and the upper portions of the rear wheels 22 and the second tangential line L2 tangent to the lower portions of the front wheels 21 and the lower portions of the rear wheels 22.

As described above, disposing the battery 40 and the collection container 60 having heavy weights at a center portion of the main body 100 in the longitudinal direction and the vertical direction improves the weight balance of the main body 100 in the longitudinal direction.

In the collector 1A of the first embodiment, the battery 40 and the collection container 60 overlap with each other in the vertical direction. This reduces variation in the position of the center of gravity due to an increase or decrease in the number of the balls 3 inside the collection container 60 and makes the main body 100 compact in the longitudinal direction.

In the collector 1A of the first embodiment, the battery 40 and the collection container 60 are disposed at the center portion of the main body 100 in the longitudinal direction and the vertical direction. This makes the main body 100 stable even if the battery 40 and the collection container 60 overlap with each other in the vertical direction.

In the collector 1A of the first embodiment, as shown in FIG. 2, the battery 40 and the collection container 60 are disposed inside of the inner ends H1 and H1 of the front wheels 21 and 21 and inside of the inner ends H2 and H2 of the rear wheels 22 and 22 to bring the weight balance of the main body 100 in the lateral direction close to equilibrium.

In the collector 1A of the first embodiment, as shown in FIG. 1, many balls 3 are held in a rear portion of the collection container 60. For this reason, the battery 40 is disposed above the front side of the bottom surface 61 of the collection container 60 to improve the weight balance of the collector 1A during the work of collecting the balls 3.

In the collector 1A of the first embodiment, the rear wheels 22 with a large outer diameter are positioned near the battery 40. This enhances the stability of the main body 100.

The collector 1A of the first embodiment has an excellent weight balance and stability during travel. Accordingly, even when the surface of the ground 2 is sloped with respect to a horizontal plane, the collector 1A is allowed to smoothly travel and collect the balls 3. Moreover, the collector 1A is unlikely to overturn when the front wheel 21 or the rear wheel 22 runs on to the ball 3 or an obstacle.

The first embodiment of the present invention has been described above. Meanwhile, the present invention is not limited to the first embodiment, and various changes can be made without departing from the object of the present invention.

In the collector 1A of the first embodiment, as shown in FIG. 1, the outer diameter of the rear wheels 22 is larger than that of the front wheels 21. Meanwhile, the outer diameter of the front wheels 21 may be larger than that of the rear wheels 22. In this case, at least part of the battery 40 may be disposed in front of the intermediate position P between the axles 21*a* and 22*a* in the side view of the main body 100. Also, the outer diameter of the front wheels 21 and the outer diameter of the rear wheels 22 may be equal.

Figure 3:
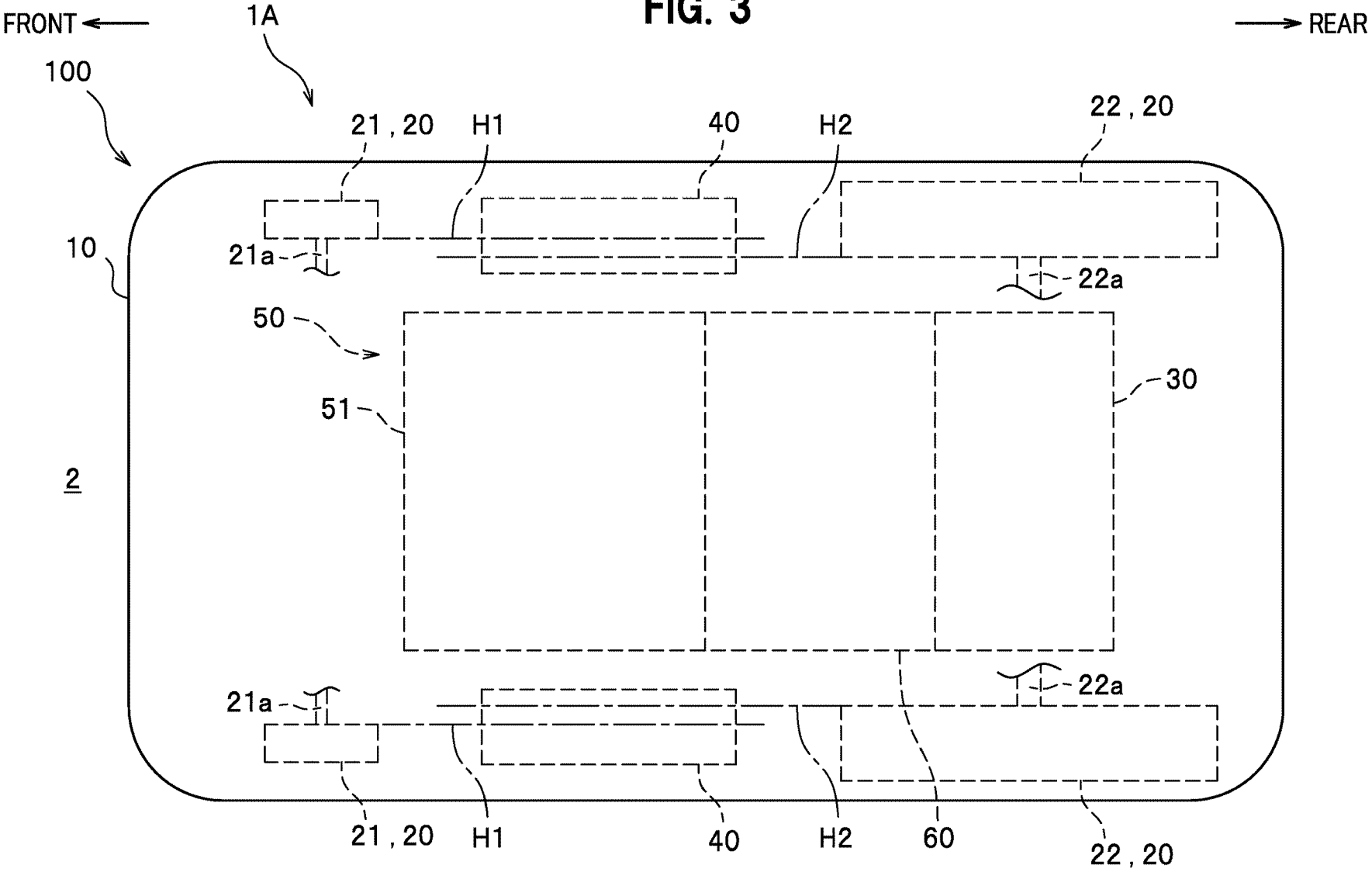
FIG. 3 is a view showing a modification of the collector according to the first embodiment of the present invention and is a plan view of a configuration provided with a plurality of batteries.

The collector 1A of the first embodiment is provided with the single battery 40. Meanwhile, it may be provided with the multiple batteries 40. For example, as shown in FIG. 3, two batteries 40 and 40 may be provided on left and right sides of the vehicle body 10, respectively. In this case, the batteries 40 and 40 may be at least partly disposed inside of the inner ends H1 and H1 of the front wheels 21 and 21 and inside of the inner ends H2 and H2 of the rear wheels 22 and 22 in a plan view of the main body 100.

In the collector 1A of the first embodiment, as shown in FIG. 1, the bottom surface 61 of the collection container 60 is inclined such that the rear side of the bottom surface 61 is lower than the front side of the bottom surface 61. Alternatively, the bottom surface 61 of the collection container 60 may be inclined such that the front side of the bottom surface 61 is lower than the rear side of the bottom surface 61. In this case, the battery 40 may be disposed above the rear side of the bottom surface 61 of the collection container 60.

As shown in FIG. 2, the travel device 20 of the first embodiment has the left and right front wheels 21 and 21 and the left and right rear wheels 22 and 22. Meanwhile, the configuration of the travel device 20 is not limited. For example, a continuous tracked travel device may be used. Also, in the travel device 20 of the first embodiment, the rear wheels 22 serve as drive wheels and the front wheels 21 serve as steer wheels. Meanwhile, the rear wheels 22 may serve as steer wheels and the front wheels 21 may serve as drive wheels. Moreover, both the front wheels 21 and the rear wheels 22 may be driven.

As shown in FIG. 1, the collector 1A of the first embodiment collects the balls 3 scattered on the ground 2 of a golf course. Meanwhile, collection targets for the collector 1A of the present invention are not limited. For example, the collector 1A can also pick up fruits or nuts on a ground of a farmland or a mountain slope.

Second Embodiment

Figure 4:
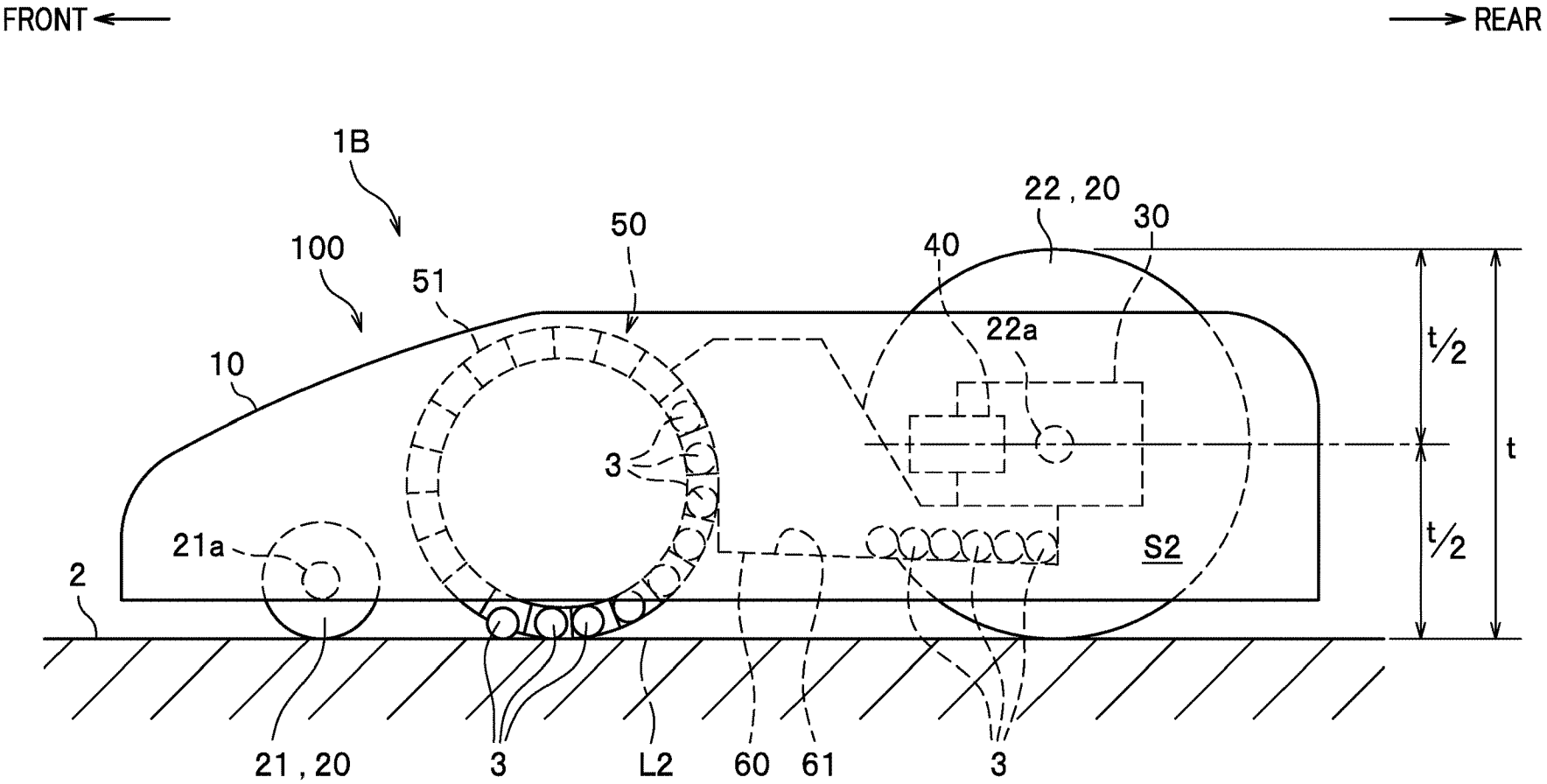
FIG. 4 is a side view showing a collector according to a second embodiment of the present invention.

Next, a collector 1B of a second embodiment of the present invention will be described. As shown in FIG. 4, a configuration of the collector 1B of the second embodiment is similar to that of the collector 1A of the first embodiment (see FIG. 1), but the position of the battery 40 in the vertical direction is different.

In the collector 1B of the second embodiment, at least part of the battery 40 is disposed in an area S2 with a height less than or equal to a half of a maximum height t of the main body 100.

With this configuration, the battery 40 having a heavy weight is disposed at a low position in the main body 100. This makes the center of gravity of the main body 100 lower, thereby enhancing stability of the collector 1B.

The second embodiment of the present invention has been described above. Meanwhile, the present invention is not limited to the second embodiment. As with the first embodiment, various changes can be made without departing from the object of the present invention.

REFERENCE SIGNS LIST

1A collector (first embodiment)
1B collector (second embodiment)
2 ground
3 ball
10 vehicle body
20 travel device
21 front wheel
21*a* axle
22 rear wheel
22*a* axle
30 driving device
40 battery
50 collection device
51 drum
60 collection container
61 bottom surface
100 main body
L1 first tangential line
L2 second tangential line

The invention claimed is:

1. A collector comprising a main body comprising:
a travel device including front and rear wheels;

an electric driving device to drive the travel device;

a battery to supply electric power to the driving device;

a collection device to pick up a collection target on a surface of ground; and a collection container to accommodate the collection target, wherein at least part of the battery and at least part of the collection container are disposed between respective axles for the front and rear wheels, respective positions of centers of gravity of the battery and the collection container are situated in an area defined between a first tangential line tangent to an upper portion of the front wheel and an upper portion of the rear wheel and a second tangential line tangent to a lower portion of the front wheel and a lower portion of the rear wheel, the collection container has a bottom surface inclined such that a rear side of the bottom surface is lower than a front side of the bottom surface, and the battery is accommodated in an upper portion of the collection container and positioned closer to the front side than to the rear side of the bottom surface.

2. The collector according to claim 1, wherein at least part of the battery and at least part of the collection container are disposed so as to overlap with each other in a vertical direction.

3. The collector according to claim 2, wherein an outer diameter of the front wheel is different from an outer diameter of the rear wheel, and at least part of the battery is disposed in front of or behind an intermediate position between the respective axles for the front and rear wheels in a side view of the main body.

4. The collector according to claim 2, wherein at least part of the battery is disposed in an area with a height less than or equal to a half of a maximum height of the main body in a side view of the main body.

5. The collector according to claim 2, wherein at least part of the battery and at least part of the collection container are disposed inside of right and left ends of the travel device in a lateral direction in a plan view of the main body.

6. The collector according to claim 1, wherein an outer diameter of the front wheel is different from an outer diameter of the rear wheel, and at least part of the battery is disposed in front of or behind an intermediate position between the respective axles for the front and rear wheels in a side view of the main body.

7. The collector according to claim 6, wherein at least part of the battery and at least part of the collection container are disposed inside of right and left ends of the travel device in a lateral direction in a plan view of the main body.

8. The collector according to claim 1, wherein at least part of the battery is disposed in an area with a height less than or equal to a half of a maximum height of the main body in a side view of the main body.

9. The collector according to claim 8, wherein at least part of the battery and at least part of the collection container are disposed inside of right and left ends of the travel device in a lateral direction in a plan view of the main body.

10. The collector according to claim 1, wherein at least part of the battery and at least part of the collection container are disposed inside of right and left ends of the travel device in a lateral direction in a plan view of the main body.

11. The collector according to claim 1, wherein at least part of the collection device is disposed between the respective axles for the front and rear wheels in a side view of the travel device.

12. The collector according to claim 11, wherein at least part of the battery is disposed between the collection device and the axle for the rear wheel in a side view of the travel device.

* * * * *